US011649105B2

(12) United States Patent
Price

(10) Patent No.: US 11,649,105 B2
(45) **Date of Patent: *May 16, 2023**

(54) CONTAINER CONSTRUCTION WITH ELEVATING BAG

(71) Applicant: Sonoco Development, Inc., Hartsville, SC (US)

(72) Inventor: Trevor Price, North Canton, OH (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/746,509

(22) Filed: May 17, 2022

(65) Prior Publication Data

US 2022/0274768 A1 Sep. 1, 2022

Related U.S. Application Data

(63) Continuation of application No. 16/832,423, filed on Mar. 27, 2020, now Pat. No. 11,365,044.

(51) Int. Cl.
*B65D 83/00* (2006.01)
*B65D 43/02* (2006.01)

(52) U.S. Cl.
CPC ..... *B65D 83/0072* (2013.01); *B65D 43/0235* (2013.01); *B65D 83/005* (2013.01); *B65D 2583/0472* (2013.01)

(58) Field of Classification Search
CPC ..... B65D 83/0072; B65D 43/0235; B65D 2583/0472
See application file for complete search history.

(56) References Cited

U.S. PATENT DOCUMENTS

| | | | |
|---|---|---|---|
| 866,243 | A | 9/1907 | Waechter |
| 1,483,196 | A | 2/1924 | Prince |
| 3,392,878 | A | 7/1968 | Jackson |
| 4,087,003 | A | 5/1978 | Adamek |

(Continued)

FOREIGN PATENT DOCUMENTS

| | | |
|---|---|---|
| CN | 103832696 | 3/2014 |
| DE | 20016989 U1 | 12/2000 |

(Continued)

OTHER PUBLICATIONS

International Search Report and Written Opinion for International Application No. PCT/US2021/013080; dated May 11, 2021; 12 pages.

(Continued)

*Primary Examiner* — Jeremy Carroll
(74) *Attorney, Agent, or Firm* — Nelson Mullins Riley & Scarborough LLP

(57) ABSTRACT

The invention is drawn to a container comprising a bottom wall and at least one sidewall extending upwardly from the bottom wall. The sidewall terminates in an edge and has an inner and an outer surface. The bottom wall and the at least one sidewall form a container interior. A flexible bag having an open end is disposed within the interior of the container and over the top edge of the container. A slide ring extends at least partially circumferentially about the outer surface of the sidewall and is affixed to the open end of the bag and frictionally engaged with the outer surface of the sidewall.

20 Claims, 15 Drawing Sheets

(56) References Cited

U.S. PATENT DOCUMENTS

| | | | | |
|---|---|---|---|---|
| 4,164,588 | A | 8/1979 | Johnson | |
| 4,377,598 | A | 3/1983 | Nugent | |
| 5,191,996 | A | 3/1993 | Jenkins | |
| 5,337,915 | A * | 8/1994 | Hall, Jr. | B65D 25/16 426/115 |
| 6,074,677 | A | 6/2000 | Croft | |
| 6,119,884 | A | 9/2000 | Lowry | |
| 6,227,441 | B1 | 5/2001 | Sagel et al. | |
| 6,422,455 | B1 | 7/2002 | Cahill et al. | |
| 6,745,918 | B2 | 6/2004 | Greene | |
| 7,556,167 | B2 | 7/2009 | Panipal et al. | |
| 8,757,053 | B2 | 6/2014 | Gonzalez | |
| 9,173,526 | B2 | 11/2015 | Berry | |
| 2003/0178429 | A1 | 9/2003 | Williams et al. | |
| 2007/0056968 | A1* | 3/2007 | Giwargis | B65D 83/005 220/8 |
| 2008/0110922 | A1 | 5/2008 | Sines | |
| 2009/0188936 | A1 | 7/2009 | Marando | |
| 2011/0123685 | A1 | 5/2011 | Bin | |
| 2015/0108122 | A1 | 4/2015 | Jimdar et al. | |

FOREIGN PATENT DOCUMENTS

| | | | |
|---|---|---|---|
| EP | 0900749 | A1 | 3/1999 |
| GB | 2500822 | A | 10/2013 |
| WO | 2013144635 | | 10/2013 |

OTHER PUBLICATIONS

Smith, Jason Poel; "How to Make a Better Pringles Can" downloaded from www.https://www.instructables.com/id/How-to-Make-a-Better-Pringles-Can/ (Jun. 25, 2020); Originally uploaded 2016.

* cited by examiner

CONTAINER CONSTRUCTION WITH ELEVATING BAG

CROSS-REFERENCE TO RELATED APPLICATION

This application is a continuation of U.S. application Ser. No. 16/832,423, filed on Mar. 27, 2020, entitled "CONTAINER CONSTRUCTION WITH ELEVATING BAG", which is incorporated herein in its entirety.

FIELD OF THE INVENTION

The present invention relates to containers having flexible bags disposed therein, wherein the flexible bags are vertically adjustable within the container.

BACKGROUND OF THE INVENTION

Food and drink products and other perishable items are often packaged in tubular rigid containers that are sealed at both ends. Cylindrical containers such as these are often used to store stacked foodstuffs such as, but not limited to, potato chips, crisps, candies, cookies, wafers, and/or crackers. With these types of containers, it can be difficult to access the food products within the container which are lower in the stack because the cross section of the containers are typically too narrow for an average adult hand to fit inside and there is little space between the side of the stack and the interior wall of the tube to grasp chips for retrieval. Often the container is inverted to pour the food product out, often resulting in spillage and breakage of the food products.

The present invention provides an improvement to the tube-stacked food container that enables the food product within the package to be dispensed in a controlled fashion without tilting the container to pour out the contents.

SUMMARY OF THE INVENTION

In an embodiment, the invention is drawn to a container comprising a bottom wall and at least one sidewall connected to the bottom wall which form a container interior. The sidewall terminates in a rolled edge opposite the bottom wall and has an inner and an outer surface. A flexible bag having an open end is disposed within the interior of the container. A slide ring comprises a circumferential portion which is substantially vertical or vertical and a finger extending therefrom and is affixed to the open end of the bag and disposed adjacent the outer surface of the sidewall, below the rolled edge. The finger of the slide ring is angled inwardly toward the sidewall and frictionally engages the sidewall. Vertical adjustment of the slide ring vertically adjusts the bag within the interior of the container.

In an embodiment, the invention is also drawn to a method for manufacturing a container. A slide ring is bonded to an open end of a flexible bag, wherein the slide ring comprises a circumferential portion which is substantially vertical or vertical and a finger extending therefrom. A container body is provided which has a bottom wall and at least one sidewall connected to the bottom wall, the sidewall terminating in a rolled edge opposite the bottom wall, and the sidewall having an inner and an outer surface, wherein the bottom wall and the at least one sidewall form a container interior. The slide ring and flexible bag are applied circumferentially to the outer surface of the sidewall, over the rolled edge, wherein the finger of the slide ring is angled inwardly toward the sidewall and frictionally engages the sidewall. Then, the flexible bag is disposed into the interior of the container, the bag is filled with products, and a top closure is applied to the container.

BRIEF DESCRIPTION OF THE DRAWINGS

While some of the objects and advantages of the present invention have been stated, others will appear as the description proceeds when taken in conjunction with the accompanying drawings, which are not necessarily drawn to scale, wherein.

DETAILED DESCRIPTION OF THE INVENTION

Figure 1:
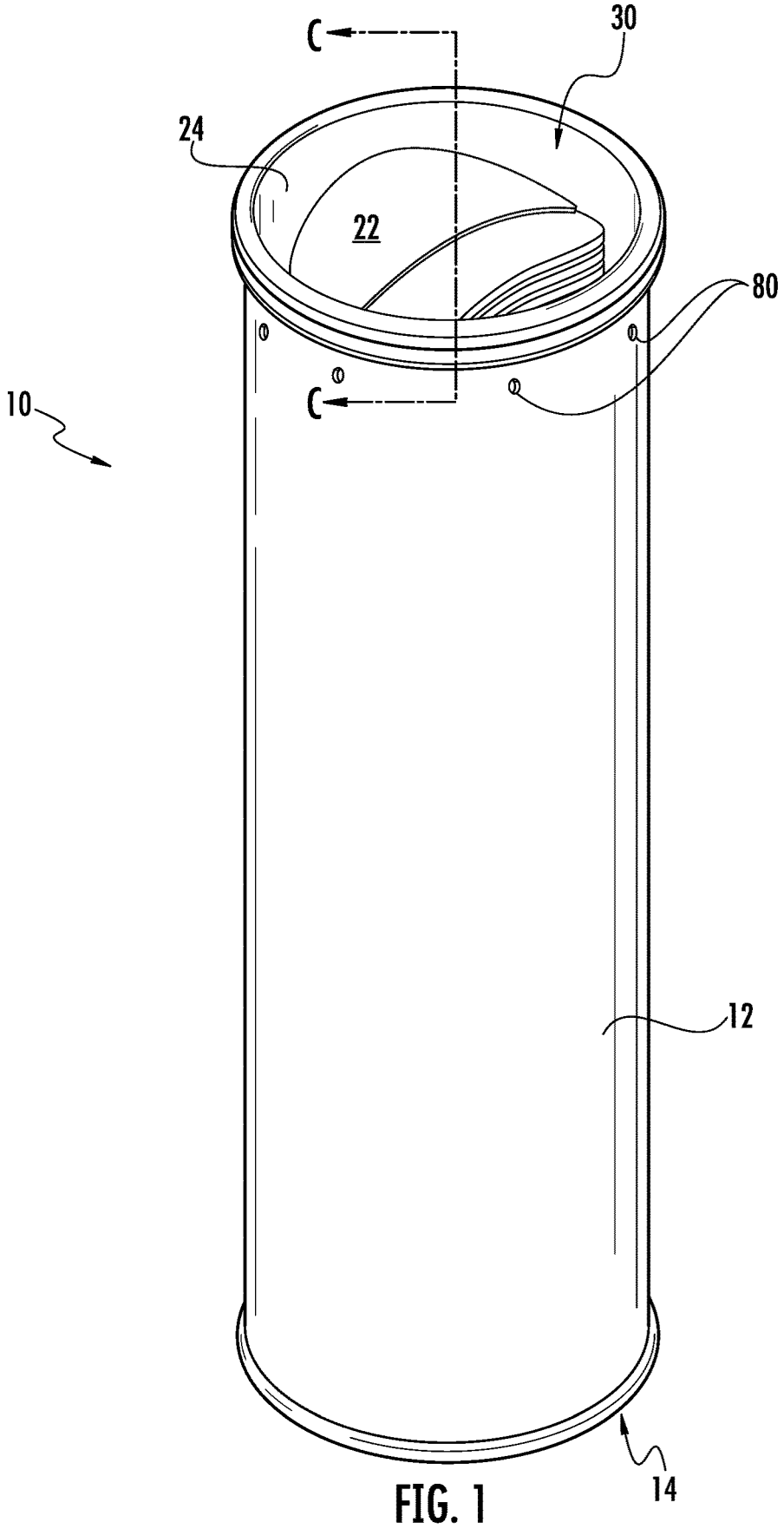
FIG. 1 is a perspective view of a container structure of the invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. Terms of reference such as "top," "bottom," or "side" are used to facilitate an understanding of the present invention in view of the accompanying figures. The identified reference terms or other similar terms are not intended to be limiting, and one of ordinary skill in the art will recognize that the present invention may be practiced in a variety of spatial orientations without departing from the spirit and scope of the invention.

Turning to the figures, a container 10 is illustrated. Although illustrated as a tube having a circular cross section, the body of the container 10 may have any cross sectional shape known in the art. For example, if the container 10 is used to store crackers, slices of bread, or magazines, the container 10 may have the general configuration of a rectangle or square, optionally with rounded corners. Likewise, the cross section of the container may be generally triangular or have a higher order polygonal profile or irregular shape. In an embodiment, the container is configured to stand stably upright on a surface.

The container 10 includes at least one vertical body wall which may be considered the sidewall 12. The container 10 may also comprise a bottom wall 14. In an embodiment, the container 10 is cylindrical or tubular. In this embodiment, the bottom wall 14 may be generally circular. In an embodiment, the container 10 may comprise multiple vertical body walls, such as four body walls, which may each be considered side walls or may be considered a front wall, a back wall, and two side walls. In this embodiment, the bottom wall may be generally square or rectangular. In an embodiment, the at least one sidewall 12 extends upwardly from the bottom wall 14. In an embodiment, the container 10 is rigid and substantially inflexible.

The at least one sidewall 12 of the container may be composed of spiral-wound paperboard, in an embodiment. In an embodiment, the sidewall 12 may comprise cardboard or another type of material, such as a molded plastic. In an embodiment, the container sidewall 12 includes a barrier layer that serves as a barrier to the passage of liquids and/or gasses such as oxygen.

In an embodiment, the sidewall 12 has an inner surface 16 which extends around an open interior 20 of the container. The container sidewall 12 has an outer surface 18 which forms the exterior of the container. The open interior 20 houses a stack or group of products, such as food products 22, in an embodiment.

In an embodiment, the container 10 is disposed upright, such that its vertical interior storage space is greater than its horizontal interior storage space. In an embodiment, the container 10 has a vertical dimension which is greater than its horizontal dimension. In an embodiment of the invention, the height of the container 10 is greater in dimension than the width of the container 10. In yet another embodiment, the length of the container 10 sidewall(s) 12 is greater than the width of the base 14 of the container.

In an embodiment, the container sidewall 12 comprises a single ply. In another embodiment, the container sidewall 12 is multi-ply. In one embodiment, a label ply may be adhered to the outer surface of the sidewall. The label ply may be constructed from materials known in the art, such as kraft paper, optionally in combination with various polymers or the like. The label ply may be inkjet printed and may convey graphics, product information, nutritional information, instructions, and/or regulatory compliance information. In other embodiments, any printed information may be integral with the sidewall 12 and/or printed directly thereon. In an embodiment, the interior surface of the sidewall 12 is treated with a barrier material or has a barrier layer applied thereto. In other embodiments, such a barrier material or layer is expressly not present.

In an embodiment, the container 10 includes a flexible bag 24 disposed at least partially inside the container body. The flexible bag 24 may comprise a polymeric material, a paper material, or any other material known in the art. In an embodiment, the flexible bag 24 is comprised of a polyethylene barrier film. The flexible bag 24 may be resilient, stretchable, and/or airtight. The bag 24 may be impermeable to liquids and gases. The flexible bag 24 may be single ply or constructed of multiple layers. The flexible bag 24 may have barrier properties.

The flexible bag 24 may, in an embodiment, be suspended within the container body. In an embodiment, the flexible bag 24 is vertically adjustable within the container 10 and selectively dispenses products 22 from the top end of the container.

In an embodiment, the container bag may have a bottom surface 26 and at least one sidewall 28 connected to and extending upwardly from the bottom surface 26 of the bag 24. In an embodiment, the bag bottom 26 is parallel or generally parallel with the base 14 or bottom end closure of the container 10. In another embodiment, the container bag 24 is a tubular structure which is cut and sealed flat on its bottom end. In this embodiment, the bottom seal of the bag 24 may be an end seal. In still another embodiment, the bag 24 may be tapered at its bottom end. Any bag configuration known in the art may be useful in the invention. In an embodiment, the shape and configuration of the bag 24 is substantially similar to or the same as the shape and configuration of the container 10. For example, if the container 10 is cylindrical, the bag 24 may also be substantially cylindrical or cylindrical. The bag 24 may have a shape and size that permit it to be disposed in the interior of the container 10 with which it is to be used.

The bag sidewall 28 may, in an embodiment, have a length (in the vertical direction) which is longer than the length of the container sidewall 12 (in the vertical direction). In an embodiment, the cross-section or horizontal circumference of the bag 24 may be slightly smaller than the cross-section or horizontal circumference of the container 10, such that the bag 24 may be disposed within the container. In an embodiment, the horizontal circumference of the bag 24 is constant or substantially constant throughout its vertical length. In an embodiment, the horizontal circumference of the container 10 may be slightly larger than the horizontal circumference (or width) of product 22 that the container is designed to contain. In an embodiment, the horizontal circumference of the bag 24 may be slightly larger than the horizontal circumference (or width) of product 22 that the container 10 is designed to contain.

In one embodiment, the container sidewall 12 is open on its top end and the sidewall 12 terminates in a top edge 32 which defines the open top end 30. In an embodiment, the bag 24 is sized so that it can be disposed at least partially over the top edge 32 of the container 10 and can be moved vertically, upwardly or downwardly, over the exterior surface of the container 10. Simultaneously, the bag 24 may move vertically, upwardly or downwardly, within the interior of the container 10. In an embodiment, the bag 24 is suspended at least slightly above the bottom end 14 of the container 10. In another embodiment, the bag 24 rests on the bottom end 14 of the container 10.

In an embodiment, a food product 22 is stacked or stored within the bag. While the food products 22 may be stacked, it should be understood that the food products 22 may be presented in any manner known in the art. For example, in some embodiments, the food products may be delicate artisan cookies that are not stacked, but it is desired to avoid breakage. In other embodiments, the food products may be peanuts and the user may desire raising them to a higher level for consumption rather than inverting the container. Thus, the invention should not be limited to stacked food products.

In an embodiment, the food product 22 does not directly contact the inner surface 16 of the container sidewall 12 due to its containment within the bag 24. Byproducts from the food product (i.e. oil, grease) are thus prevented from contact with or migrate into the container body. In this way, the container body can be easily recycled after the bag 24 is removed from its interior. Likewise, the bag 24 can also be recycled.

In an particular embodiment, the bag 24 suspends and supports the food product 22, resulting in a reduction in broken or damaged food products 22. Further, use of the bag 24 may avoid the need for a barrier film or barrier layer to be applied to the interior surface 16 of the container body, thereby reducing costs, manufacturing time, and improving the recyclability of the container.

Figure 2:
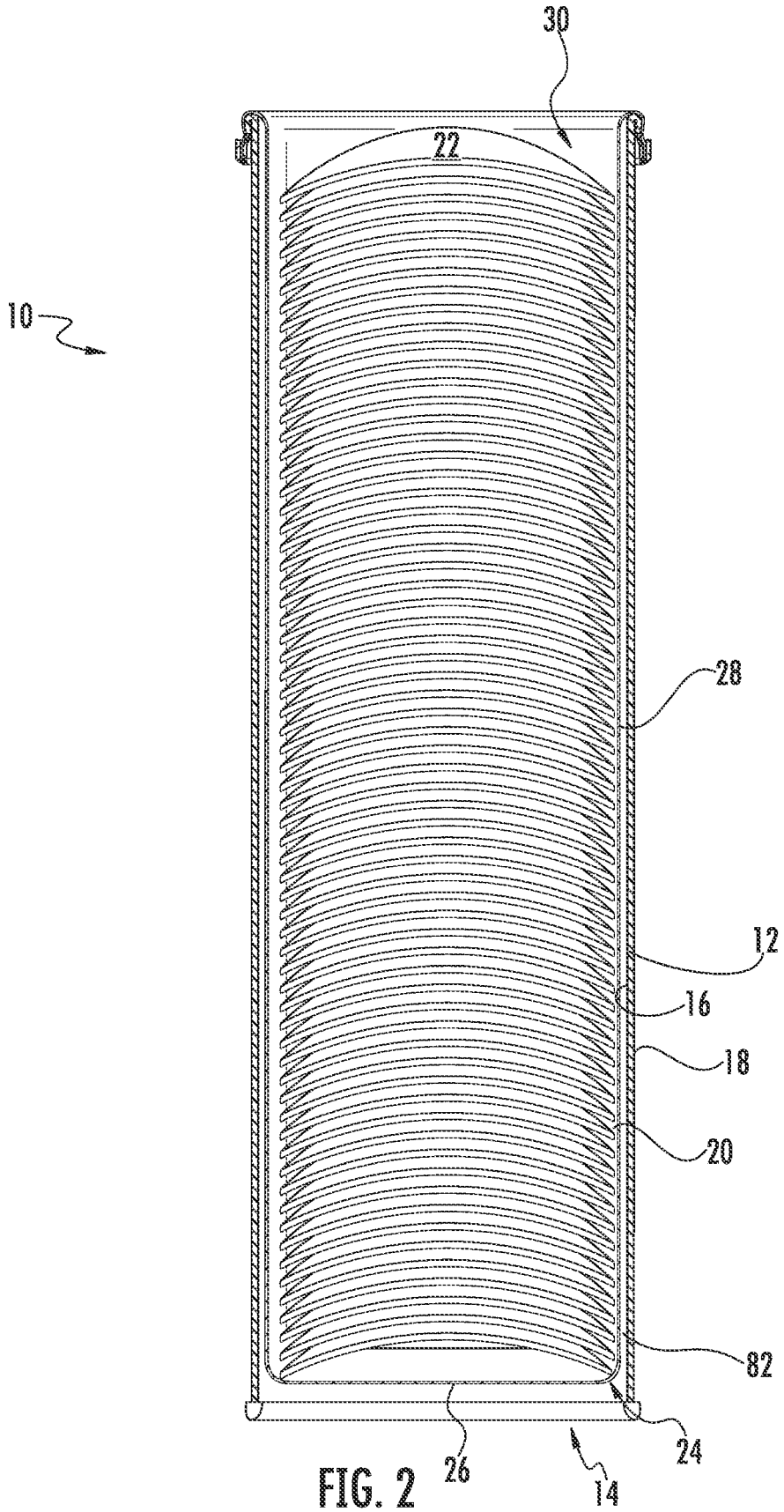
FIG. 2 is a cross-sectional view of a container structure of the invention.

In an embodiment, the apparatus additionally comprises a slide ring 34 (see FIGS. 2-3) disposed on the outer surface 18 of the container 10. In the drawings, the slide ring 34 is configured having a circular or ring-like shape. It will be appreciated, however, that the slide ring 34 may be constructed in a configuration and size that permit it to traverse the outer surface of the container with which it will be used. For example, in the illustrated embodiment, a circular slide ring 34 extends around the exterior of the cylindrical container sidewall 12.

In an embodiment, the slide ring 34 may extend around less than the full circumference of the outer surface of the container, optionally depending on the configuration of the container. In any case, the slide ring 34 extends around at least a portion of the exterior sidewall surface 18. In an embodiment, the fit between the slide ring 34 and the exterior sidewall 18 of the container is a friction fit. That is, the slide ring 34 is movable upwardly and downwardly, vertically, against the outer surface 18 of the container 10 by applying human force to the slide ring 34. In an embodiment, however, the frictional engagement between the inner surface of the slide ring 34 and the outer surface 18 of the container 10 is such that when no human force is applied to the slide ring 34, the slide ring 34 remains in position (regardless of its position) due to frictional forces between the slide ring 34 and the outer surface 18 of the container 10. The friction engagement between the slide ring 34 and the exterior sidewall surface 18 should be sufficient to suspend the bag 24 and the food products 22 contained in the bag 24 in a variety of vertically adjusted positions above the container bottom 14. The slide ring 34 may be constructed of any material known in the art, such as paperboard, molded plastic, or any other material. In a particular embodiment, the slide ring 34 is comprised of high density polyethylene.

In an embodiment, the bag 24 has an inner surface 36 and an outer surface 38. In a particular embodiment, the slide ring 34 is bonded to the outer surface 38 of the bag 24. Likewise, in another embodiment, the slide ring 34 is bonded to the inner surface 36 of the bag 24. In any case, the slide ring 34 in bonded to the bag 24 near or at the upper end of the bag 24 which is or will be initially disposed near the open top end 30 of the container. The bonding may be accomplished using any adhesive known in the art. In an embodiment, the bag 24 is ultrasonically bonded to the slide ring 34. In another embodiment, the bag 24 is inductively sealed to the slide ring 34.

In yet another embodiment, the slide ring 34 is configured to pinch the bag between two portions of the slide ring 34 and secure the bag 24 in place. In an embodiment, the bag 24 is bonded to the slide ring 34 and the slide ring 34 is configured to pinch the open end of the bag 24 between two portions of the slide ring 34. In an embodiment, the inner surface 26 and the outer surface 28 of the bag are in contact with the slide ring 34.

The bag 24 may be displaced upwardly or downwardly by moving the slide ring 34. The bottom 26 of the bag 24 may be selectively positioned in a vertically adjusted position relative to the container bottom wall 14. As the slide ring 34 is moved downwardly over the exterior surface 18 of the container 10 (relative to the container bottom wall 14), the bag bottom 26, and thus any product 22 contained within the bag 24, is adjusted upwardly within the container interior (relative to the container bottom wall 14). Food products 22 contained within the bag 24 are raised to the top edge 32 of the container and can be easily grasped or dispensed from the open end 30. After consumption or use, the container contents can be lowered, if desired, by moving the slide ring 34 upwardly over the exterior surface 18 of the container 10 (relative to the container bottom wall 14).

Alternatively, the container contents can be maintained at the dispensing level based upon the frictional engagement, as noted above. The invention allows bag 24 movement to a variety of vertically adjusted positions. These positions can be maintained without manually holding the container 10 or bag 24 due to the friction engagement of the slide ring 34 and the container side wall 12. The inventive system allows the stack of food products 22 to move up and down within the container in a smooth and continuous manner, so that the stack can be raised or lowered to any desired elevation in immediate response to movement of the slide ring 34.

Figure 3:
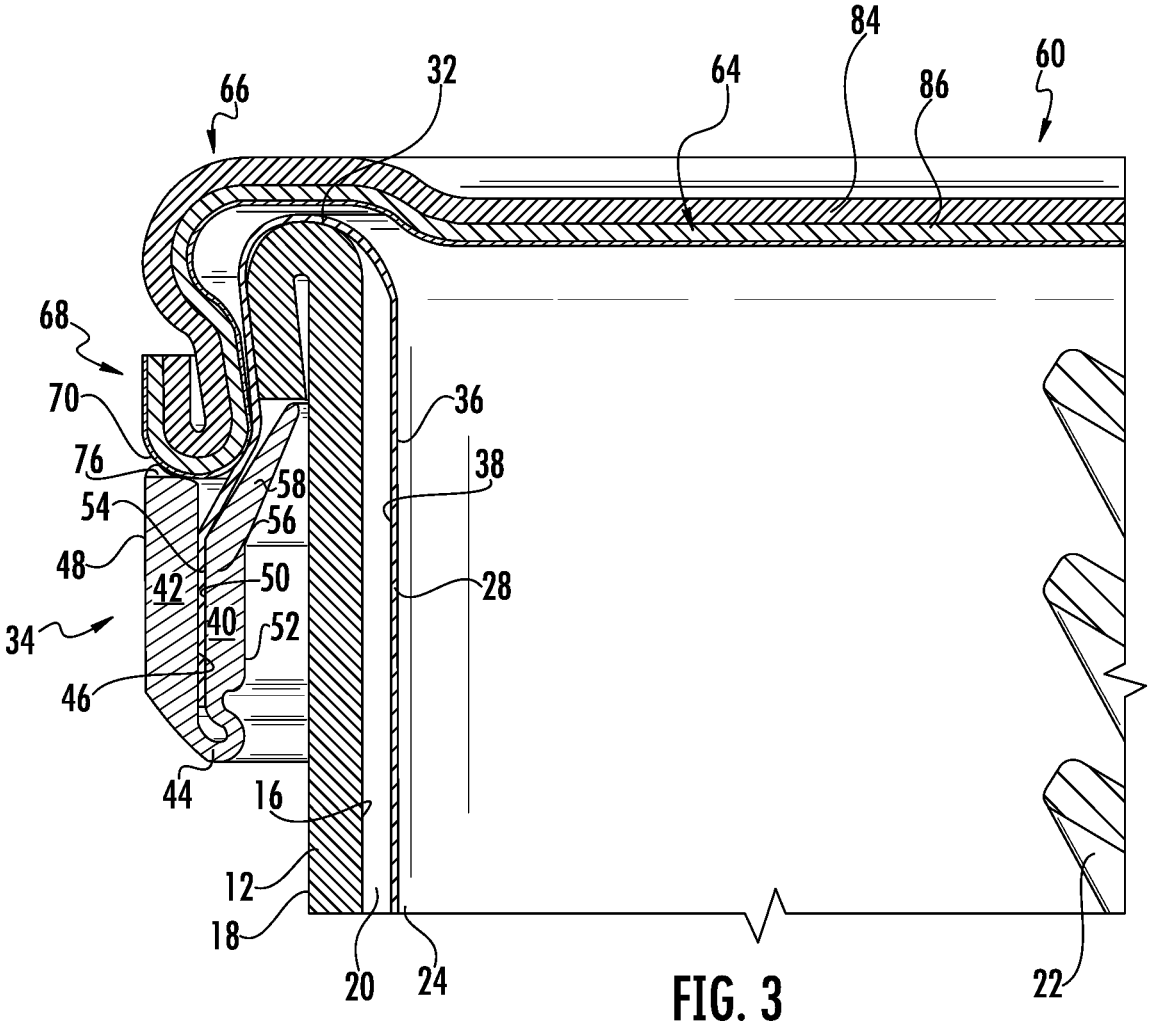
FIG. 3 is an exploded view of the top edge of a container structure of the invention.
Figure 4:
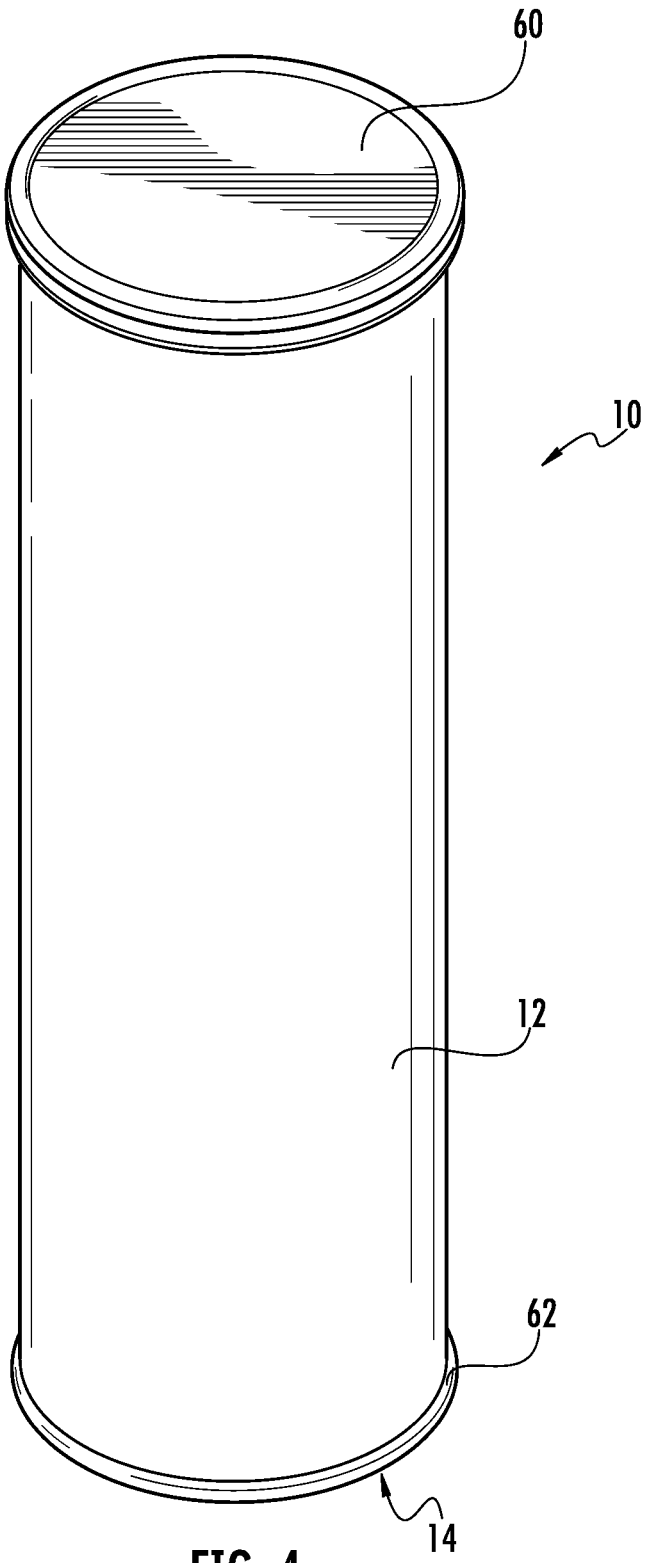
FIG. 4 is a perspective view of a container structure of the invention with the overcap disposed on the container.
Figure 5:
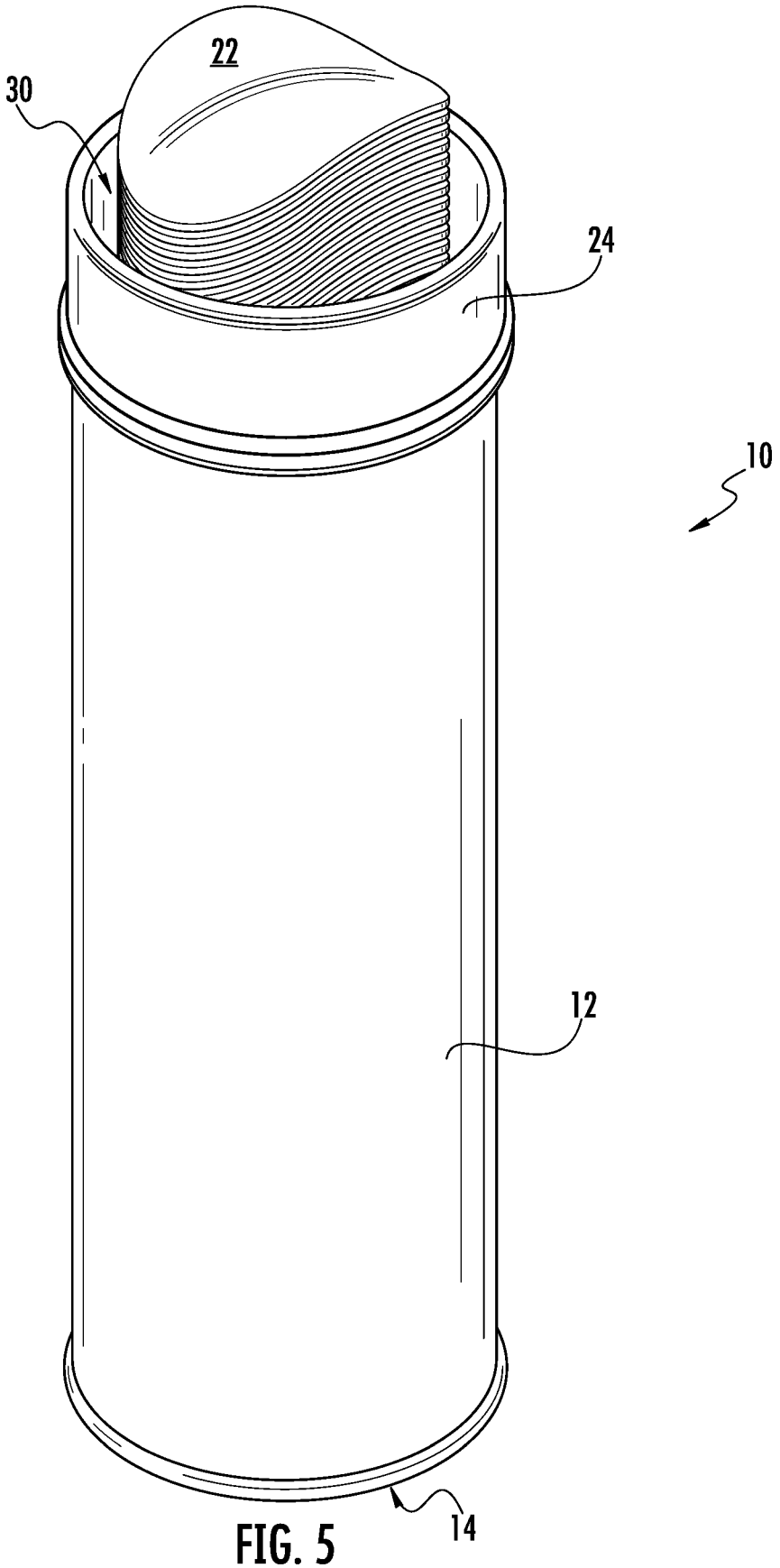
FIG. 5 is a perspective view of a container structure of the invention with the overcap removed and the slide ring disposed downward of the top end of the container.
Figure 6:
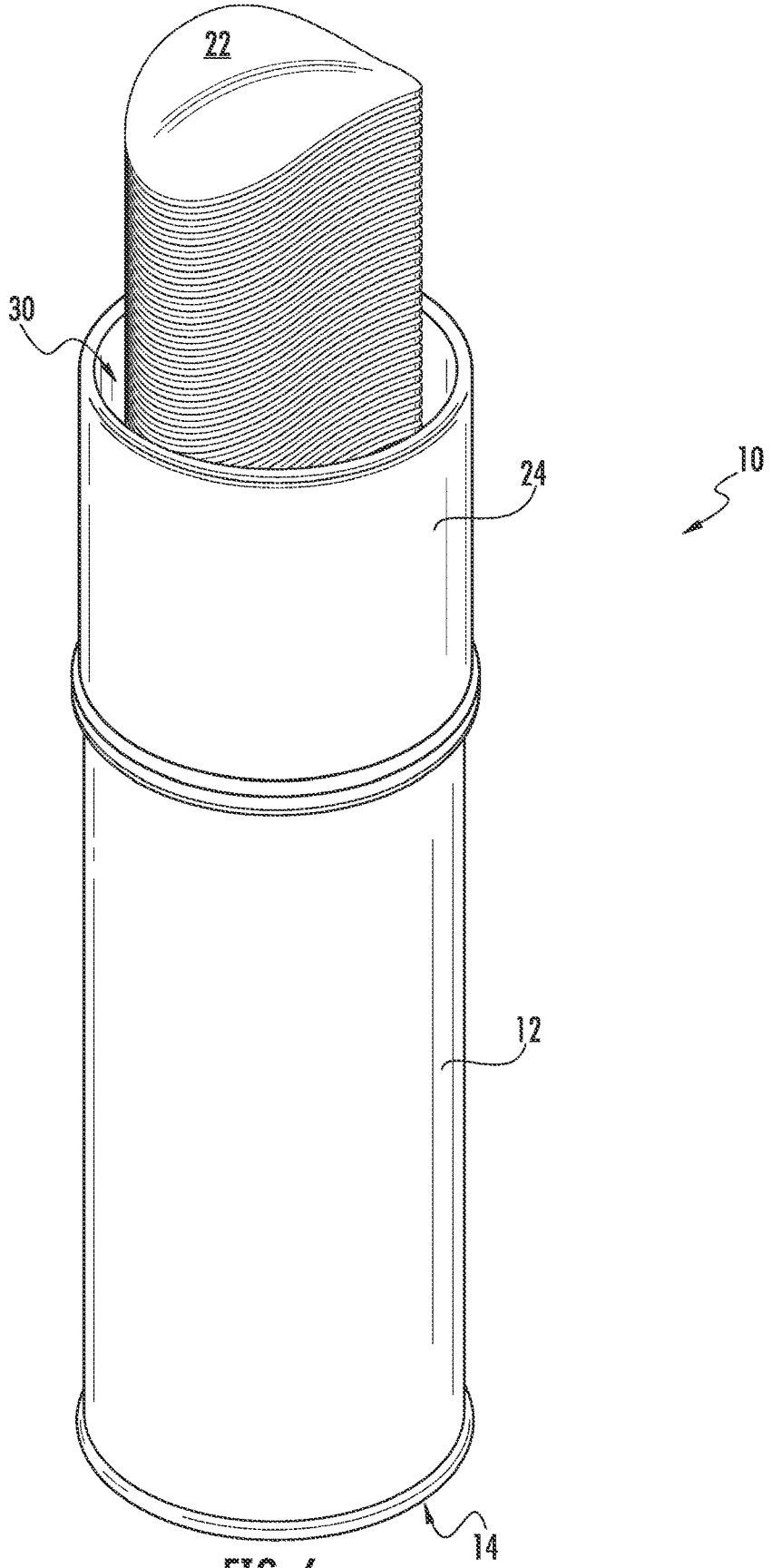
FIG. 6 is a perspective view of a container structure of the invention with the overcap removed and the slide ring disposed downward of the top end of the container.
Figure 7:
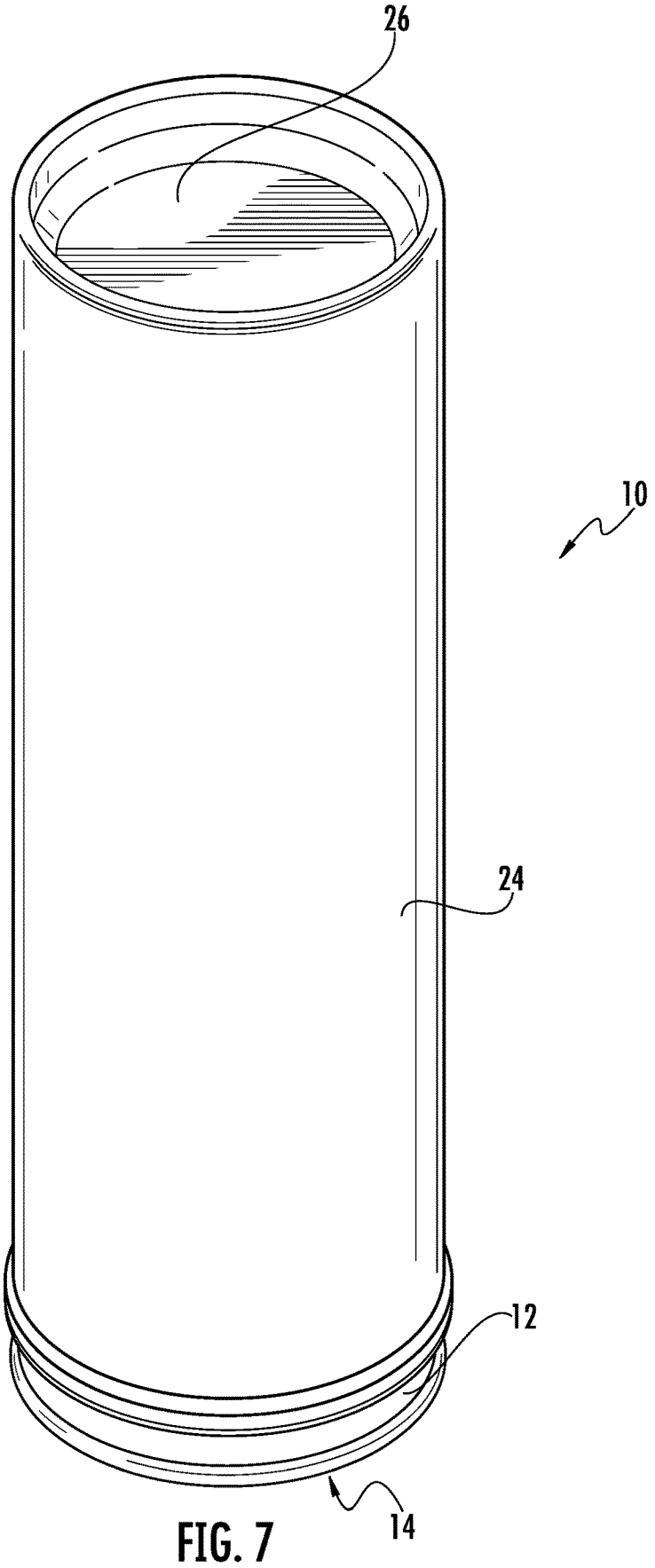
FIG. 7 is a perspective view of a container structure of the invention with the overcap removed and the slide ring disposed downward of the top end of the container.
Figure 8A:
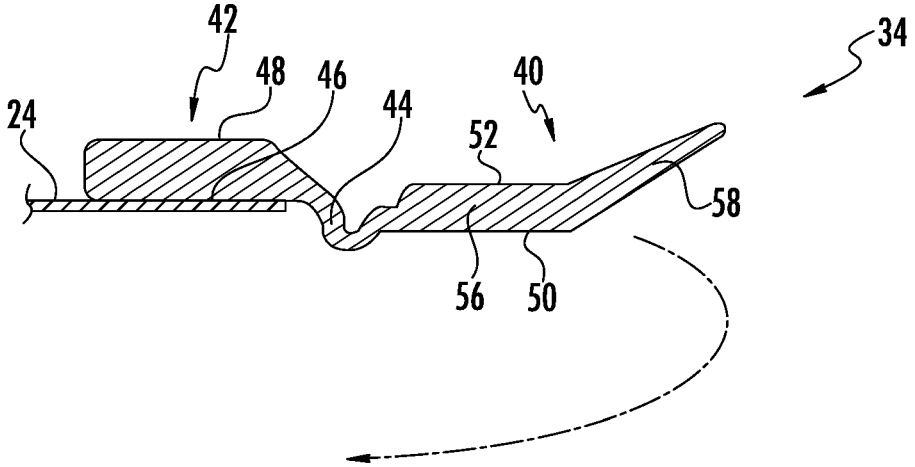
FIGS. 8A-B illustrate a cross-sectional view of a slide ring of the invention, illustrated before (8A) and after (8B) deformation.
Figure 8B:
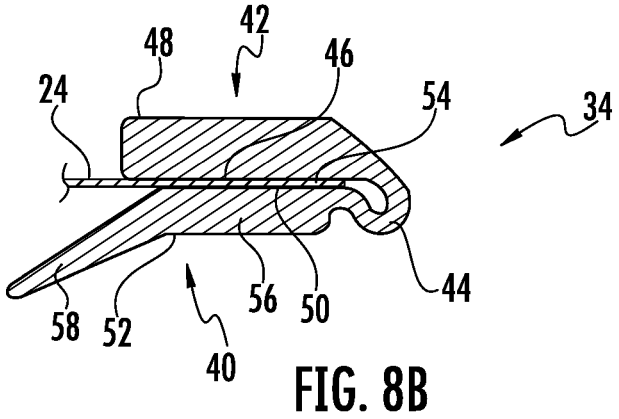

Referring to FIGS. 3 and 8A-8B, the slide ring 34 may have a construction as shown. In an embodiment, the slide ring may be circumferential about the container sidewall. In an embodiment, the slide ring 34 may comprise an inner leg 40 and an outer leg 42, with reference to the proximity of each leg to the container body. The inner leg 40 and outer leg 42 may be connected by a hinge 44. The inner leg 40 may be disposed adjacent the outer surface 18 of the container sidewall 12.

The outer leg 42 may have an interior surface 46 and an exterior surface 48. The interior surface 46 of the outer leg 42 may face the inner leg 40. The exterior surface 48 of the outer leg 42 may face the atmosphere outside the container 10. In an embodiment, the interior surface 46 of the outer leg 42 may be in contact with the bag 24 and/or the inner leg 40. In an embodiment, the interior surface 46 of the outer leg 42 may be bonded to the bag 24. In an embodiment, this bonding may occur along the inner surface 36 of the bag 24.

The inner leg 40 may have an interior surface 52 and an exterior surface 50. The interior surface 52 of the inner leg 40 may face the exterior surface 18 of the container sidewall 12. The exterior surface 50 of the inner leg 40 may be in contact with the bag 24 and/or the outer leg 42. In an embodiment, the exterior surface 50 of the inner leg 40 may be in a secure engagement with the bag 24 and/or the outer leg 42.

Likewise, the interior surface 52 of the inner leg 40 may be in contact with the bag 24. In an embodiment, the interior surface 52 of the inner leg 40 may be in a secure engagement with or bonded to the bag 24.

In an embodiment, the engagement between the inner leg 40 and outer leg 42 (with the pinched bag section 54 between them) may be considered a pinched or a locked physical configuration. In another embodiment, the inner leg 40 and outer leg 42 (with the pinched bag section 54 between them) may be transformed, conglomerated, and/or melded such that they become unitary and inseparable. This may occur through the application of pressure and/or heat. In an embodiment, the exterior surface 50 of the inner leg 40 may be bonded to the bag 24 (in addition to or in place of the bonding between the outer leg and the bag). In an embodiment, this bonding may occur along the outer surface 38 of the bag 24.

In an embodiment, the vertical length of the inner leg 40 may be greater than the vertical length of the outer leg 42. The inner leg 40 may comprise a generally vertical portion 56 and a finger 58 extending therefrom. The generally vertical portion 56 may be vertical or substantially vertical.

Figure 9:
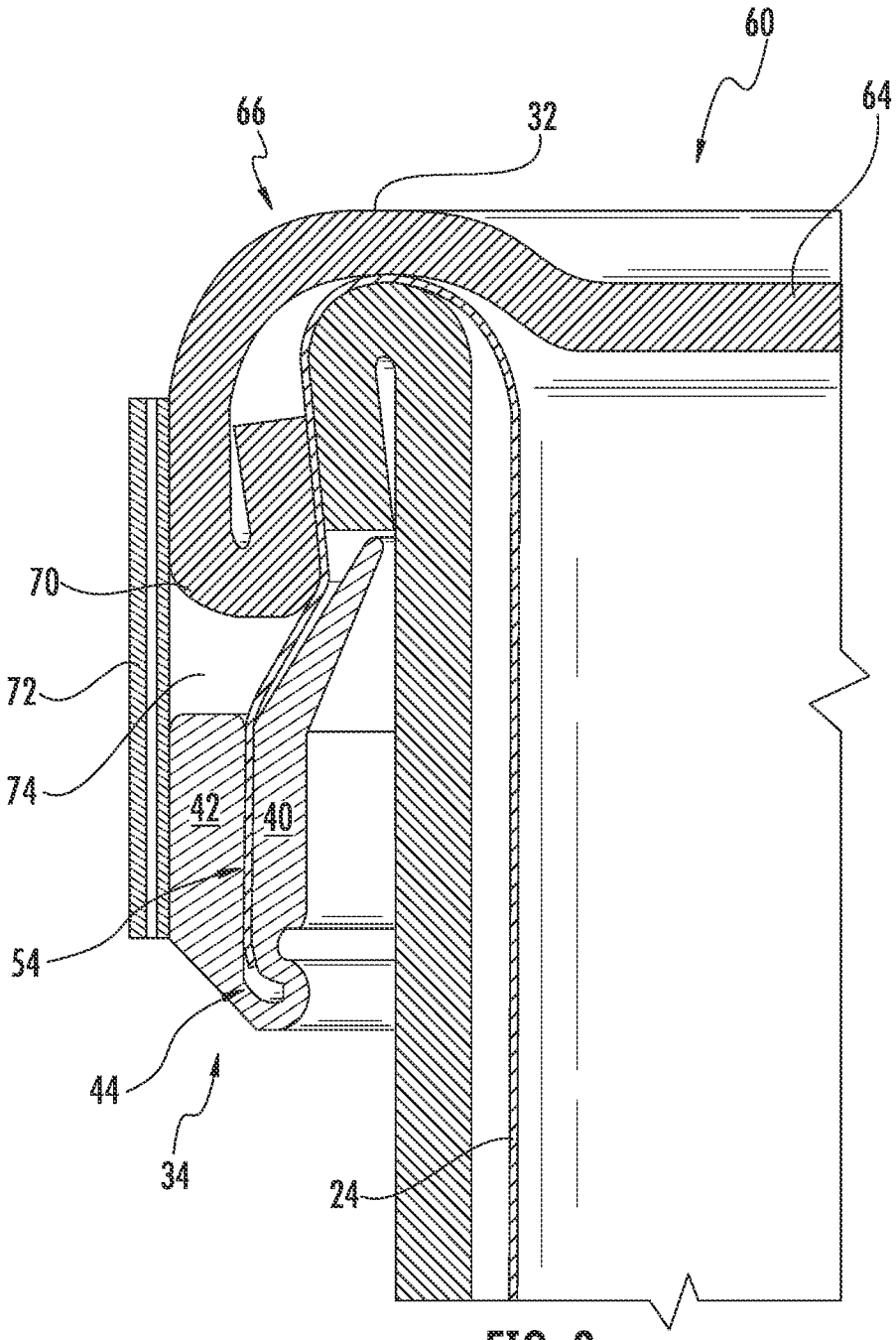
FIG. 9 illustrates an exploded cross-section view of a container structure of the invention.
Figure 10:
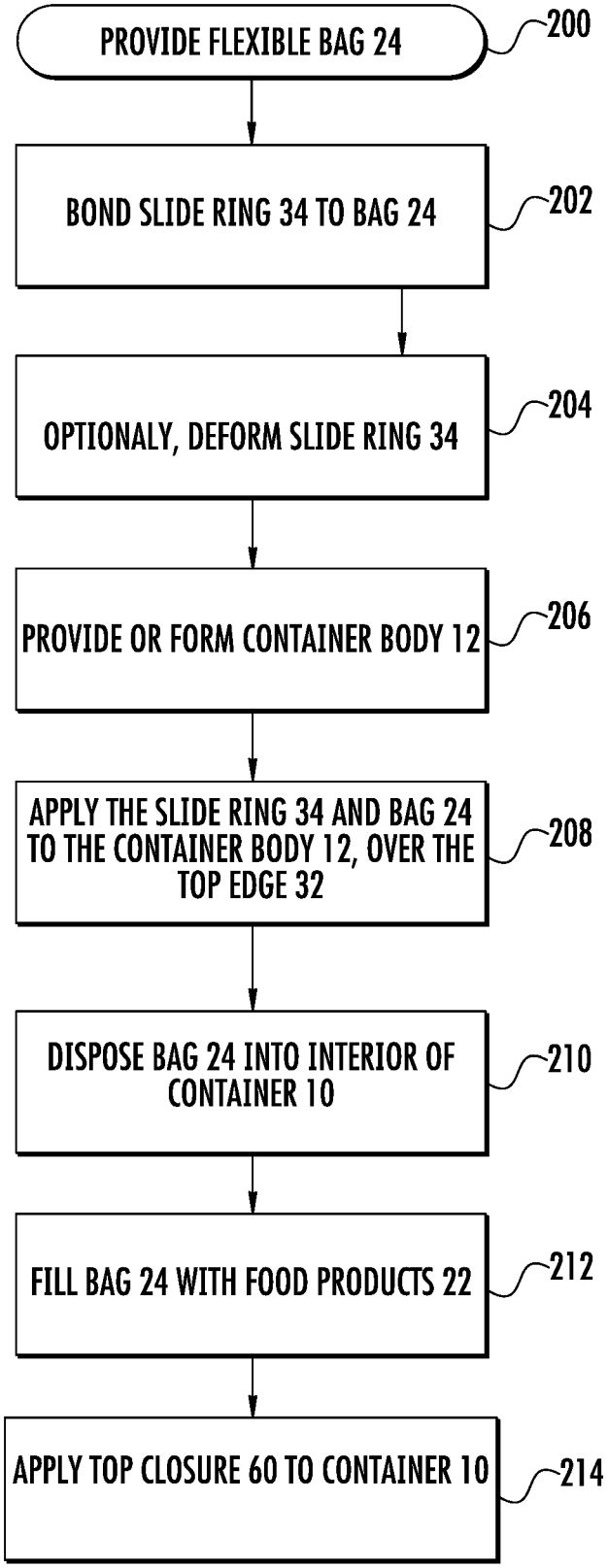
FIG. 10 illustrates a method of the present invention.

The outer leg 42 may be vertical or substantially vertical. In an embodiment, the configuration of the outer leg 42 and the generally vertical portion 56 of the inner leg 40 is the same or substantially the same. That is, both the outer leg 42 and the generally vertical portion 56 of the inner leg 40 may both be vertical, parallel to the longitudinal axis of the container 10. In an embodiment, the length of the outer leg 42 and the generally vertical portion 56 of the inner leg 40 is the same or substantially the same (shown in FIGS. 8A, 8B, and 9). In other embodiments, however, the length of the outer leg 42 is greater than that of the generally vertical portion 56 of the inner leg 40 (shown in FIG. 3).

Figure 13A:
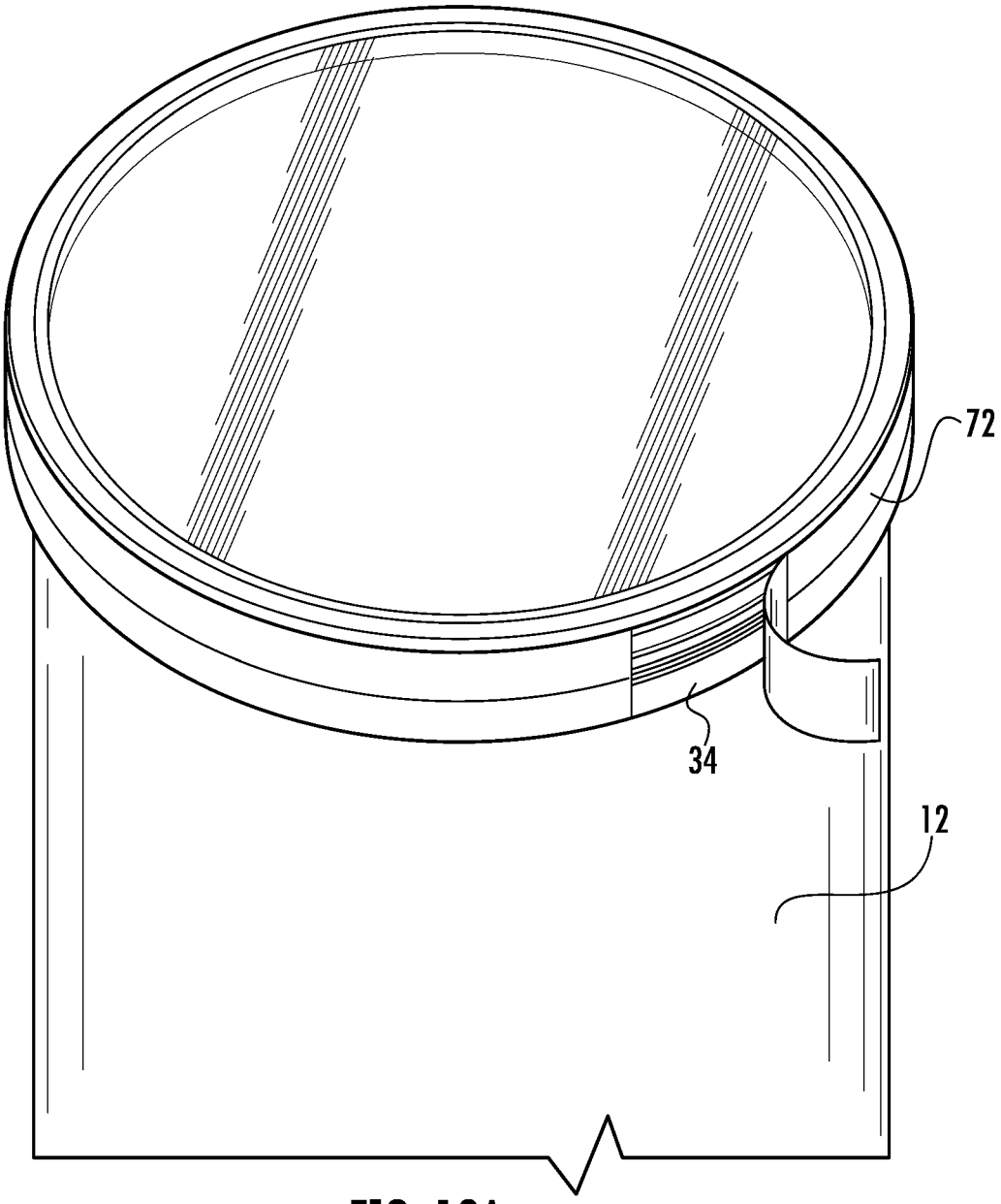
FIGS. 13A and 13B illustrate alternate embodiments of a container of the present invention.
Figure 13B:
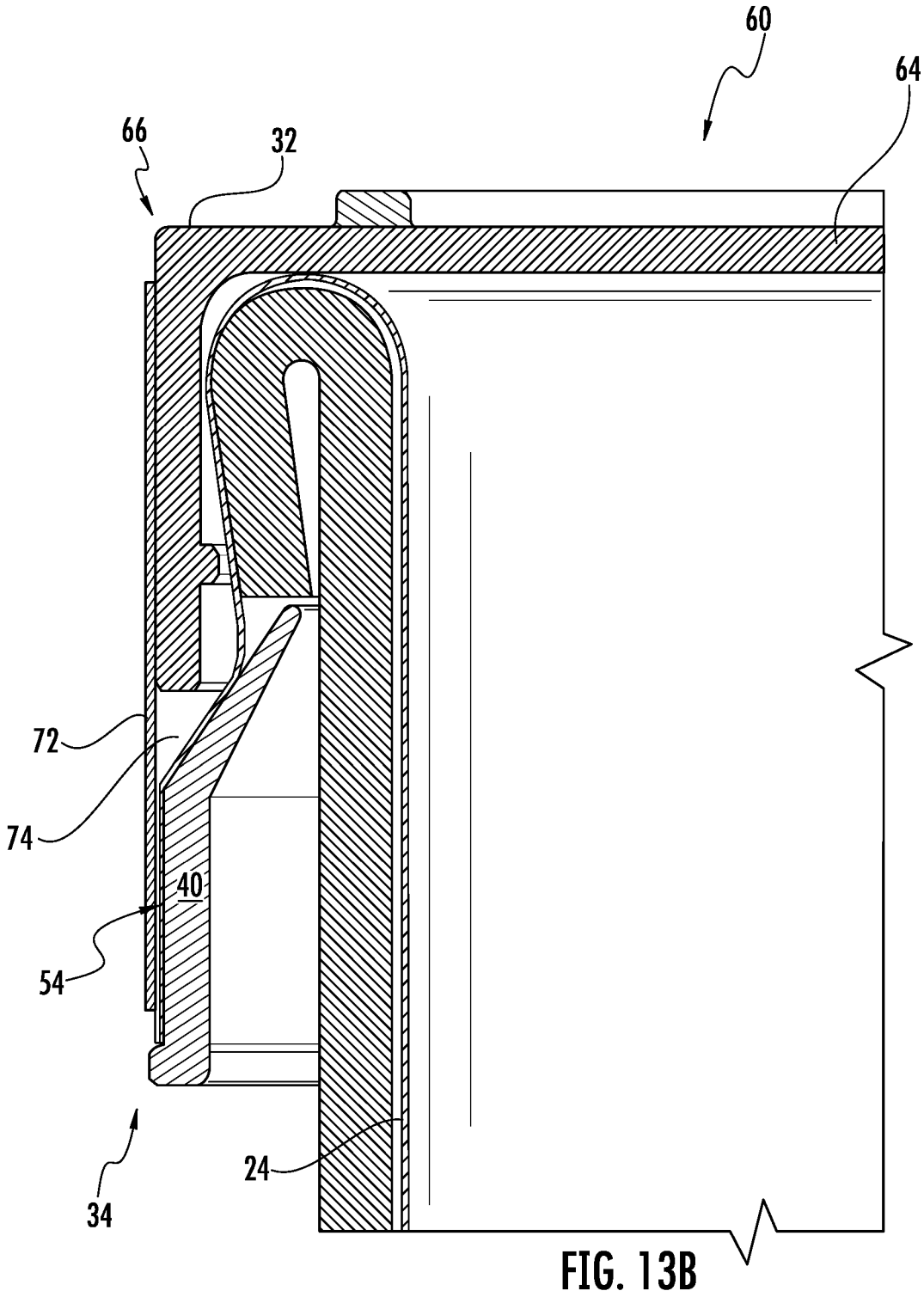

Referring to FIGS. 13A-13B, the slide ring 34 may have an alternate construction as shown. In this embodiment, the slide ring 34 may comprise an inner leg 40, but may not have an outer leg as discussed above. The inner leg 40 may be disposed adjacent the outer surface 18 of the container sidewall 12.

In this embodiment, the inner leg 40 may have an interior surface 52 and an exterior surface 50. The interior surface 52 of the inner leg 40 may face the exterior surface 18 of the container sidewall 12. The exterior surface 50 of the inner leg 40 may be in contact with the bag 24. In an embodiment, the exterior surface 50 of the inner leg 40 may be in a secure engagement with the bag 24. In an embodiment, the adhesion of the inner leg 40 and the bag 24 may be secured through the application of adhesives, pressure and/or heat. In an embodiment, the exterior surface 50 of the inner leg 40 may be bonded to the bag 24. In an embodiment, this bonding may occur along the outer surface 38 of the bag 24. In an embodiment, the bonding of the inner leg 40 and the bag 24 may occur over the surface of the generally vertical portion 56. In another embodiment, the bonding of the inner leg 40 and the bag 24 may occur over the surface of the generally vertical portion 56 and at least a portion of the finger 58.

In an embodiment, the inner leg 40 may comprise a generally vertical portion 56 and a finger 58 extending therefrom. The generally vertical portion 56 may be vertical or substantially vertical. At the base of the vertical portion 56, the inner leg 40 may terminate in an edge or lip 57. The lip 57 may bulge slightly outwardly, away from the container sidewall 12.

Figure 14A:
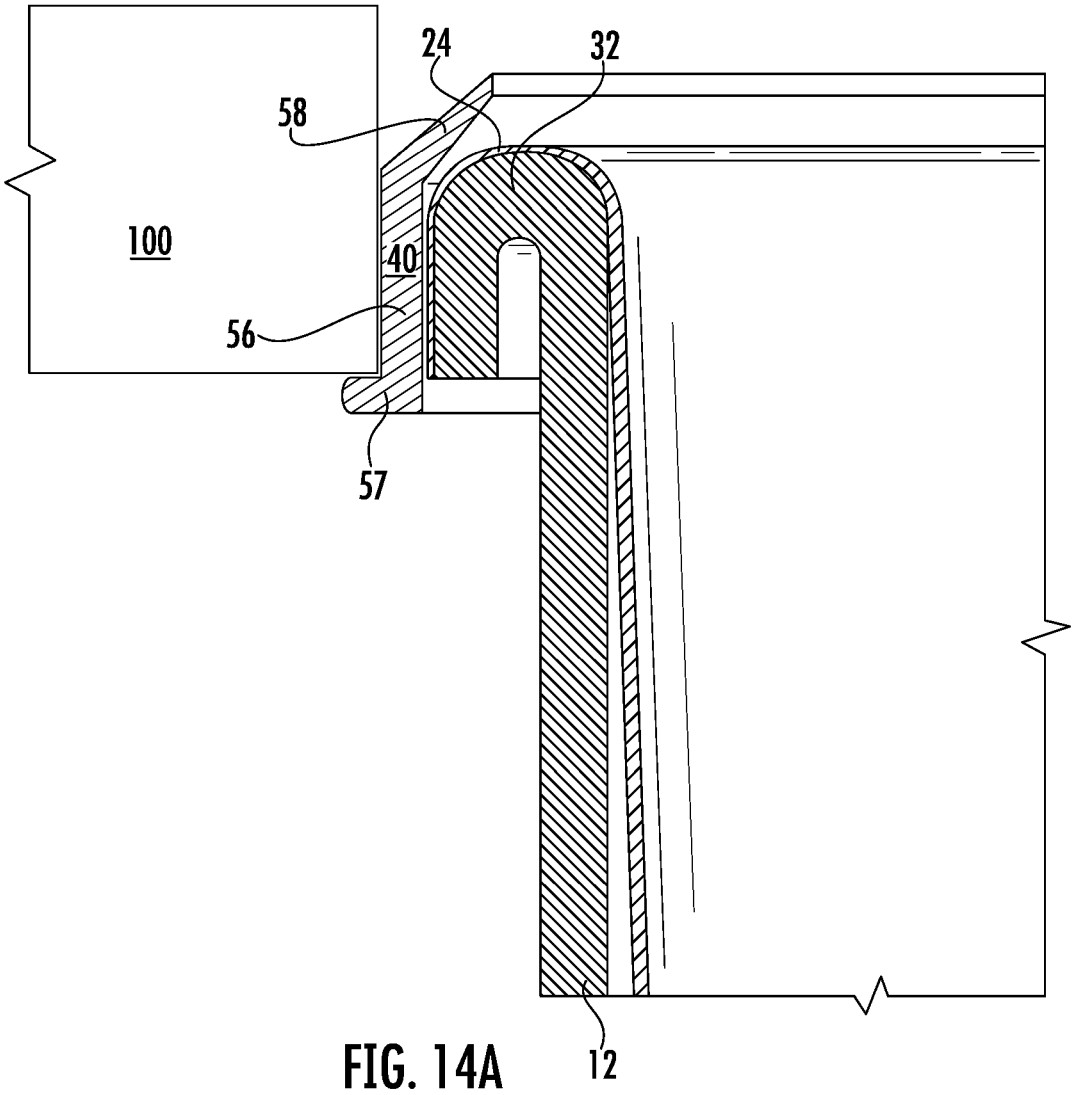
FIGS. 14A and 14B illustrate an alternate embodiment of the container of the invention in various stages of formation.
Figure 14B:
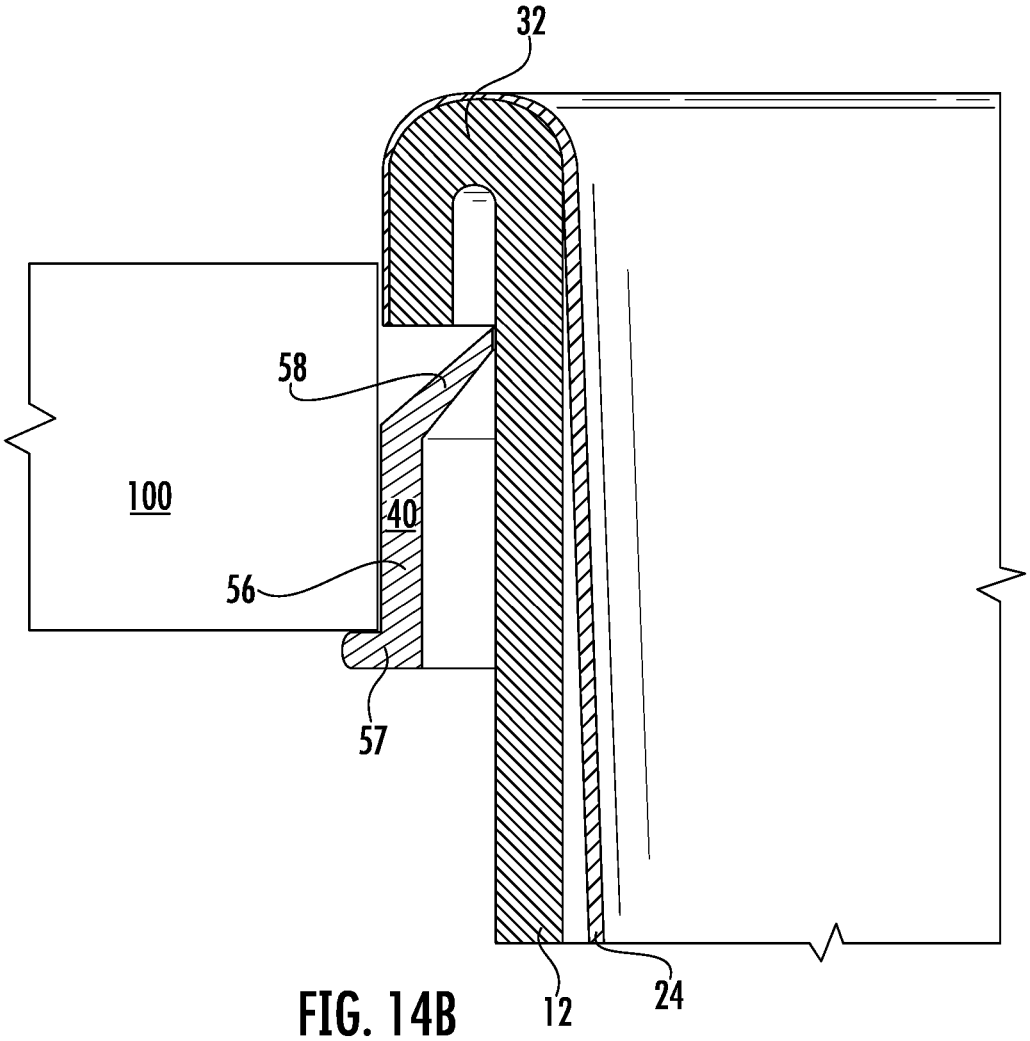

In an embodiment, the lip 57 may be configured to receive a tool 100 which is used to insert the slide ring 34 over the container 10. FIGS. 14A-14B illustrate the application of the slide ring 34, in an embodiment, over the rolled edge 32 of the container sidewall 12. The tool 100 catches on the lip 57 and pushes the slide ring 34 from the top of the container toward the bottom of the container, over the rolled edge 32, until the finger 58 passes over the rolled edge 32 and engages the container sidewall 12.

The generally vertical portion 56 of the inner leg 40 and/or the finger 58 of the inner leg 40 may frictionally engage the container sidewall 12. In an embodiment, only the finger 58 of the inner leg frictionally engages the container sidewall. That is, in an embodiment, the inner leg 40 of the slide ring 34 is not in direct contact with the container sidewall. In an embodiment, the inner leg 40 of the slide ring 34 is not in frictional contact with the container sidewall. In an embodiment, the inner leg 40 of the slide ring 34 is in slidable contact with the container sidewall.

In an embodiment, the finger 58 is angled toward the container sidewall 12 such that it provides resistance to movement of the slide ring 34 upwardly. The finger 58 may extend upwardly from the generally vertical portion 56 of the inner leg 40 and may angle inwardly, toward the container sidewall 12. The finger 58 may allow movement of the slide ring 34 downwardly but resist movement of the slide ring 34 upwardly. In an embodiment, the slide ring 34 rides along the container side wall, downwardly, with a clamping force that prevents or resists upward movement. In an embodiment, the clamping force is due to the finger 58. In an embodiment, the finger 58 is forced to bend or deflect slightly, which creates a frictional or clamped engagement. In an embodiment, the finger 58 is forced to bend toward vertical, creating pressure against the container sidewall 12.

The finger 58 may be circumferential or may be presented in one or more discrete locations about the circumference of the slide ring 34. That is, more than one finger 58 may be utilized. In an embodiment, the finger 58 may prevent movement of the slide ring 34 past a rolled top edge 32 of the container sidewall 12. The finger 58 may be narrower at its distal end as compared to the end which connects to the generally vertical portion 56 of the inner leg 40.

The hinge 44 which connects the inner leg 40 to the outer leg 42 may be of any construction known in the art. In an embodiment, the hinge 44 is curved in a manner which allows the inner leg 40 (or, in alternate embodiments, the outer leg 42) to be moved from a first position to a second position, wherein the second position is disposed against the bag 24 and outer leg 42 (or, in alternate embodiments, against the bag 24 and inner leg 40). In an embodiment of the slide ring 34 prior to deformation of the hinge 44, the outer surface 48 of the outer leg 42 and the inner surface 52 of the inner leg 40 are facing in the same direction. The hinge 44, in this embodiment, may comprise a convex curve between the inner leg 40 and the outer leg 42. The hinge 44, may be C-shaped or U-shaped, such that the open end of the "C" or "U" is disposed in the same direction as the outer surface 48 of the outer leg 42 and the inner surface 52 of the inner leg 40. In this embodiment, one side of the "C" or "U" may be connected to the inner leg 40 and the other side of the "C" or "U" may be connected to the outer leg 42. In an embodiment, the inner leg 40 is deformed to form the slide ring 34 such that the outer surface 50 of the inner leg 40 is brought around to meet the inner surface 46 of the outer leg 42, with the pinched bag portion 54 disposed between the inner leg 40 and the outer leg 42.

In an embodiment, the outer surface of the slide ring 34 is textured, ribbed, or has a profile which aids in its grippability. In an embodiment, outer surface 48 of the outer leg 42 is textured, ribbed, or has a profile which aids in its grippability.

In one embodiment, the tubular container 10 of the present invention includes a top end closure 60 and a bottom end closure 62. In an embodiment, the top end of the container 10 may be closed via a flexible membrane seal that is affixed to the top edge of the tubular container 10. The flexible membrane seal may be made of a flexible laminate film(s), kraft paper, foil, and/or extruded polymers and may be heat sealed or adhesively attached to the end of the tubular container 10. In an embodiment, a removable overcap is disposed over the membrane seal. In another embodiment, the top end closure comprises an overcap without a flexible membrane. The overcap may be made of paper, plastic, metal, foil, any combination thereof, or any other material(s) known in the art.

In an embodiment, the overcap 60 is configured to snap-fit onto the rolled rim 32 of the container sidewall 12. In an embodiment, the overcap 60 is configured to seal closed the opening 30 of the container 10 and/or enclose the interior of the container. In an embodiment, the overcap 60 is removable, replaceable, and can be affixed to the container 10 with the bag 24 in any vertical position. In an embodiment, the overcap 60 is fitted against the container rim 32 such that movement of the slide ring 34 downwardly (and, respectively, movement of the bag 24 inside the container 10 upwardly) is prevented when the overcap 60 is applied to the container 10.

In an embodiment, the overcap 60 may comprise multiple layers of paperboard. In this embodiment, the cap 60 may contain a barrier layer and/or a barrier treatment may be applied to one or more of the paperboard layers. In an embodiment, the cap 60 may contain a foil layer, optionally on the interior of the cap, facing the interior of the container.

Regardless of the shape of the container 10, the overcap 60 is designed to snugly fit over the edge 32 of the container sidewall 12 to enclose the container contents. In an embodiment, if the container 10 is cylindrical, the overcap 60 is generally circular or disk-shaped and conforms to the dimensions of the container 10. In this embodiment shown in FIG. 3, the overcap 60 may comprise a central portion 64 and an outer peripheral portion 66 extending generally radially outwardly from the central portion and extending circumferentially about the central portion 64. The peripheral portion 66 of the overcap 60 is configured to mate with the edge 32 or rim of the container sidewall 12.

The peripheral portion 66 may terminate in a curl 68. In an embodiment, the curl 68 is generally disposed downwardly, in an axial direction of the overcap 60, and rolls outwardly. Alternatively, the curl 68 may roll inwardly. The curl 68 may be at least partially flattened or pinched, in an embodiment.

In an embodiment, the curl 68 is disposed adjacent the slide ring 34 on its lower end. In a particular embodiment, the curl 68 lower end 70 is adjacent the outer leg 42 of the slide ring 34. In yet another embodiment, the curl lower end 70 is affixed or fused to the outer leg 42 of the slide ring 34, through a heat seal, adhesive, sealant, ultrasonic bonding, induction sealing, or any other method known in the art. In this embodiment, an adhesive or sealant may be applied to the lower end 70 of the curl 68 prior to its application onto the container 10. In an embodiment, the lower end 70 of the curl 68 is adjacent, but not affixed to, the bag 24.

In an embodiment, the outer leg 42 of the slide ring 34 may be configured near its upper end 76 to fit the dimensions of the lower end 70 of the curl 68 (see FIG. 3). For example, the upper end 76 of the outer leg 42 of the slide ring 34 may be angled or curved so that its juncture with the lower end 70 of the curl 68 is flush or substantially flush.

The bottom end closure 62 of the tubular container 10 may be constructed of metal, paper, plastic, or any other material known in the art.

In an embodiment, one or more tamper evidence features may be presented within the container structure. Many tamper evidence features are known in the art and are encompassed within the invention. In one embodiment (shown in FIG. 9 and FIG. 13A-13B), a tear strip 72 is disposed about the overcap 60 and/or slide ring 34. In this embodiment, the tear strip 72 may have a tab 73 which can be released and pulled, allowing the tear strip 72 to be progressively separated from the container structure until it is completely removed (shown in FIG. 13A). The tear strip 72 may then be discarded. The tear strip 72 may comprise any materials known in the art. In an embodiment, the tear strip 72 may be a peelable tape.

In this embodiment, the tear strip 72 may cover all or substantially all of the slide ring 34, preventing movement of the slide ring 34 prior to removal of the tear strip 72. In this embodiment, the outer leg 42 of the slide ring 34 need not be in contact with the overcap 60 and a space 74 may be disposed between the outer leg 42 and the lower end 70 of the overcap 60.

In another embodiment, the tear strip 72 may cover the interface or space between the overcap 60 and the slide ring 34, preventing removal of the cap 60 prior to removal of the tear strip 72. In an embodiment, the tear strip 72 prevents movement of the slide ring 34 and prevents removal of the cap 60 until the tear strip 72 is removed.

In an embodiment, the container sidewall 12 contains one or more through holes 80 (see FIG. 1). The through holes 80 may be disposed near the upper end of the sidewall 12. In an embodiment, the through holes may be disposed near the rim 32 of the sidewall 12. The through holes 80 may allow air from the atmosphere to pass into the internal cavity of the container 10. The through holes 80 may be small, discreet and/or disguised using labeling graphics. The bag 24 prevents the any air which passes through the through holes 80 from contacting any food product 22 contained within container 10. The through holes 80 may aid in preventing implosion or deformation of the container 10 due to atmospheric changes or vacuum conditions. The through holes 80 may also allow easier movement of the bag 24 within the container interior, decreasing suction and/or vacuum forces that may otherwise resist movement of the bag 24 within the container 10.

As an additional advantage to the invention, if/when a vacuum is created within the container 10, the flexible nature of the bag 24 allows it to move inwardly against the food products 11, equalizing the pressure on the inside and outside of the bag 24. As the bag 24 moves inwardly, a space 82 may develop between the bag 24 and the sidewall 12. To the extent the container 10 has at least one through hole 80, air may move between the external atmosphere and the interior of the container, avoiding a vacuum within the container 10 and/or implosion of the container 10. In another embodiment, the container sidewall 12 is a relatively porous construction, optionally of paperboard, which allows for a sufficient migration of air through the sidewall 12 such that the space 82 between the bag 24 and the sidewall 12 remains at atmospheric or ambient pressure. Thus, the sidewall 12 is not subjected to negative pressure over an extended period, which could cause the container 10 to collapse or implode.

In an embodiment, the overcap 60 is a multilayer structure, optionally with a foil layer on its interior surface. In an embodiment, the overcap 60 may be a multilayer paperboard structure, but the overcap 60 may alternatively be a plastic multilayer structure, if desired. In an embodiment, the overcap 60 contains at least two layers, a upper layer 84 and a lower layer 86 (see FIG. 3). Additional layers may be presented within the construction. For example, a foil layer may be disposed beneath the lower layer 86.

In an embodiment, the container 10 of the invention is hermetically sealed, preventing the ingress or egress of gases, liquids, or other particles, until the container 10 is opened by a consumer. In an embodiment, the slide ring 34 and bag 24 are removable from the container 10 after consumption of the product 22 contained therein. In one embodiment, the container body, and particularly the top edge of the container body, may be slightly crushed or deformed by the consumer so that the slide ring can pass over the rolled edge 32 of the container 10 for separation of the bag 24 and slide ring 34 from the container 10. In another embodiment, the bag 24 may be pierced or cut, optionally near its bottom end 26, and the slide ring 34 may then pass over the bottom edge of the container 10 for separation of the bag 24 and slide ring 34 from the container 10. The finger 58 will not prevent movement of the slide ring 34 over the bottom edge of the container due to its structure.

The container 10 of the present invention provides numerous advantages. Primarily, the container 10 provides an easier mechanism for removal of the products 22 contained within, by elevating the products 22 as needed for easier grasping and removal. The container 10 also provides a product which is fully recyclable. The bag 24 and slide ring 34 can be removed from the container 10 after use and can be recycled as plastics. The container 10 and overcap 60 can be recycled as paper. The use of a barrier material or barrier layer within the container 10 can be eliminated due to the presence of the separate bag 24, saving manufacturing time, costs, and resources. Further, the food product 22 contained within the inventive container 10 is better protected from breakage and damage due to the supportive bag 24. Still further, the container 10 is better adaptable to changes in atmospheric and/or processing conditions which alter pressure on the interior or exterior of the container 10, as described herein.

Method of Manufacture

Figure 11:
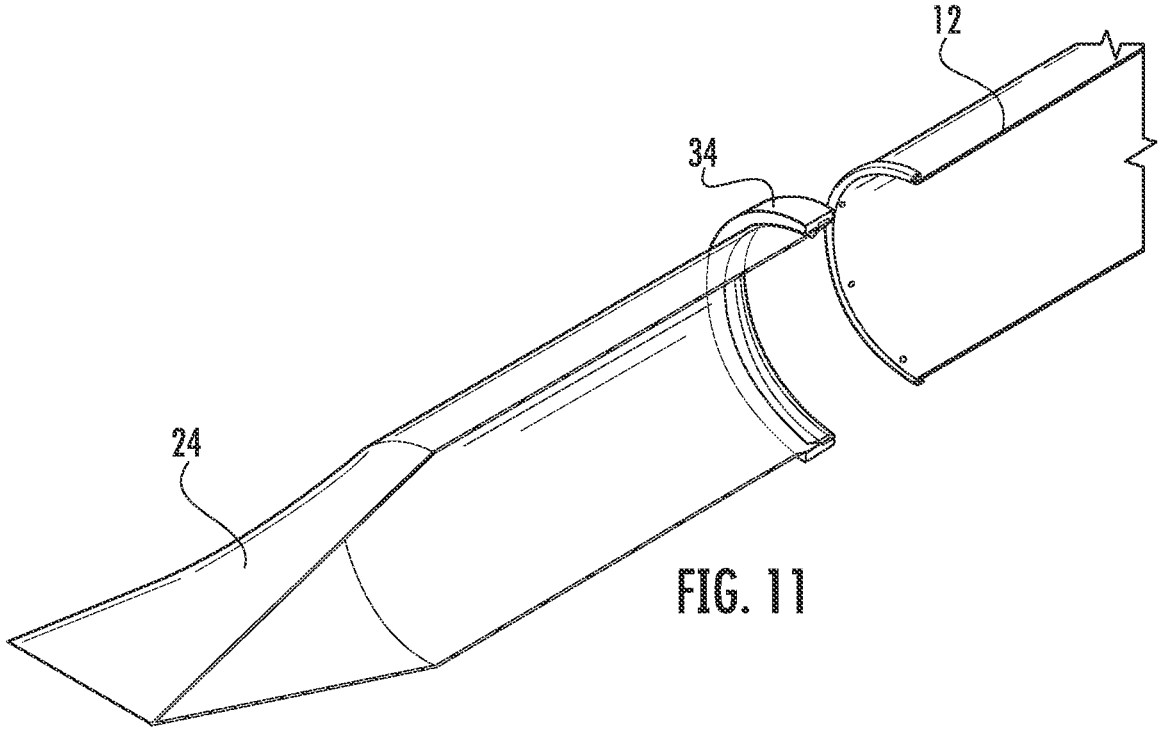
FIGS. 11 and 12 illustrate an embodiment of the container of the invention in various stages of formation.

The container 10 of the present invention may be manufactured by the process illustrated in FIG. 11. Initially, a container body and a flexible bag may be formed or provided, likely in separate processes. In an embodiment, tubular bags 24 are manufactured which are similar in size and dimension to the container 10 within which they will be inserted. In an embodiment, the tubular bags 24 may be manufactured by rolling a film layer into a tube or cylindrical shape and creating a longitudinal seal. The continuous tubular film may then be cut into discrete lengths. In an embodiment, each discrete length of tubular film is at least as long as the discrete lengths of tube used to make container 10. One end of the discrete tubular film may be sealed closed to create a bottom seal. It should be understood that any process for manufacture of the inventive bag is contemplated (see Step 200).

In an embodiment, a first tool is inserted into the open end of the bag 24 wherein the first tool is dimensioned to fit within the bag 24. The first tool may be generally cylindrical and may have a tapered portion which is narrower near its distal end. The narrower tapered portion may aid in insertion of the tool into the bag 24. The first tool may be dimensioned such that its diameter increases as the distance from the distal end increases. The bag 24 may be inserted onto the tool until the bag 24 is fitted snugly onto the tool at or near at least the open end of the bag 24. In an embodiment, the open end of the bag 24 is firmly fitted onto the first tool. The closed end (or bottom) 26 of the bag 24 may not be disposed on the first tool in some embodiments and may hang loosely from the end of the tool. In other embodiments, the entirety of the bag 24 is disposed on the first tool during this portion of the process.

At Step 202, in an embodiment, the slide ring 34 is then applied to the bag 24. The slide ring 34 may be disposed in a flattened initial position, as shown in cross-section in FIG. 8A. The slide ring 34 may comprise a concentric ring or disc which may be slid onto the bag/first tool, over the bottom end 26 of the bag 24, moving toward the top end of the bag. Once the slide ring 34 reaches the open end of the bag, it may be adhered to the edge of bag 24. As noted above, the outer leg 42 may be adhered to the bag via ultrasonic bonding. In an embodiment, an adhesive is applied to the bag 24. In another embodiment, an adhesive is applied to the outer leg 42 of the slide ring 34. In either case, the component parts are then ultrasonically bonded together.

In an embodiment, a second tool is applied to the exterior of the slide ring 34 and provides pressure against the first tool to aid in the bonding of the slide ring 34 and the bag 24. The second tool may comprise two halves of a ring which compress the slide ring 34 against the bag 24. In an embodiment, the second tool may apply pressure and heat to the slide ring 34 and bag 24.

At optional Step 204, the first tool may be withdrawn from the interior of the bag 24. The second tool may maintain its position on the exterior of the slide ring 34. In an embodiment, the inner leg 40 of the slide ring 34 is then bent along the hinge 44, toward the outer leg 42 of the slide ring 34, such that the bag 24 is disposed between the two legs 40, 42. This may be accomplished using the second tool or a third tool. At this stage, the finger 58 of the inner leg 40 is directed toward the interior of the bag 24. As can be appreciated, the inner leg 40 could alternatively be adhered to the bag 24 and the outer leg 42 could be bent along the hinge 44, toward the inner leg 40.

In an embodiment, the container body 12 is then provided. The container body may be formed via spiral winding, though any method of forming the container body may be used. In a spiral wound embodiment, a continuous strip of body ply material is supplied to a winding apparatus and is first passed through a pair of opposed edge skivers. The edge skivers remove part of the square edge of the body ply to create first and second edges having a beveled configuration. The body ply is then wrapped around a shaping mandrel from opposite sides of the mandrel. Each ply is first wrapped under the mandrel and then back over the top in a helical fashion. As the body ply is further wrapped and the first edge of the body ply advances back under the mandrel after one complete revolution, it is brought into contact with the second edge of the ensuing portion of the body ply which is first coming into contact with the mandrel. The skived edges become overlapped and an applied adhesive adheres the edges together to form a spirally wound tube which advances along the mandrel.

The tube is then advanced down the mandrel by a winding belt, which extends around a pair of opposed pulleys. The winding belt not only rotates and advances the tube, but also applies pressure to the overlapping edges of the body ply to ensure a secure bond between the respective edges. In some embodiments, an outer label ply is then passed over an adhesive applicator and wrapped around the body ply. At a cutting station, the continuous tube is cut into discrete lengths before being removed from the mandrel.

In a particular embodiment, at least one of the ends of the tubular container sidewall 12 is rolled outwardly to form a top rim 32 which provides a suitable surface for affixing a top end closure 60. A bottom end closure, such as a metal or paper closure, may be attached to the bottom end of the container 10.

Figure 12:
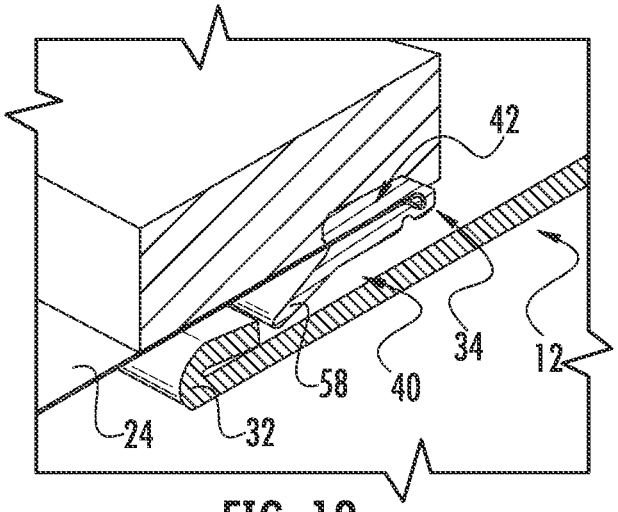

In the next step, Step 208 in FIG. 11, the slide ring 34 and bag 24 combination is then applied to the container body 12 (see FIG. 12A). In an embodiment, the slide ring 34 and bag 24 combination is applied to the top rolled edge 32 of the container body 12. The slide ring 34 is fitted over the open end 30 of the container 10 and is pushed toward the bottom end 14 of the container 10. The finger 58 of the inner leg 40 deflects or flexes outwardly to allow movement of the slide ring 34 over the top rolled edge 32 of the container 10. Once it passes over the top rolled edge 32 (shown in FIG. 12B), the finger 58 of the inner leg 40 then flexes inwardly, toward its natural position. There may be a physical and/or audible snap when the finger 58 passes over the rolled edge 32 and flexes inwardly into contact with the container sidewall. The inward flexing of the finger 58 prevents reverse movement of the slide ring 34 over the rolled edge 32 in the opposite direction, due to its angled configuration. In an embodiment, the generally vertical portion 56 of the inner leg 40 of the slide ring 34 passes fittedly over the top rolled edge 32, but is not otherwise in direct contact with the container sidewall.

After the slide ring 34 passes over the rolled edge 32 of the container 10, the second and/or third tools may be removed and the bag 24 may be air blown from the bottom 26 of the bag 24, forcing the bag 24 into the interior portion 30 of the container 10 with the burst of air. Similarly, prior to application of the bottom closure to the container 10, a vacuum or suction could be applied to the bottom end of the container sidewall 12 to such the bag 24 into the container interior 30. In any case, the bag 24 is inverted such that it is disposed within the interior 30 of the container 10 (Step 210).

The bag 24 may then be filled with food products 22 at Step 212. After filling with food products 22, a top end closure 60 is applied to the container body 12 at Step 214. Optionally, a tamper evidence strip may be applied to the structure such that it covers at least a portion of the slide ring 34 and/or top end closure 60. The tamper evidence strip may prevent movement of the slide ring 34 and/or removal of the closure 60 prior to removal of the tamper evidence strip. In other embodiments, the top end closure 60 may be treated with an adhesive prior to application to the container 10 and adhered and/or bonded to the slide ring 34 such that movement of the slide ring 34 is prevented prior to removal of the top end closure 60.

The container 10 is easy to manufacture, yet is capable of withstanding a rigid shape and providing a hermetic seal to prevent air and moisture from contaminating the products contained therein.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, the tubular containers according to the present invention are not necessarily helically wound but may instead be longitudinally wrapped to create a "convolute" tube having an axially extending seam. In addition, although the tubular containers according to the present invention have been described primarily in connection with food products, it is to be understood that the containers could be used in connection with other products. It should be understood that any stackable product which can be stored and dispensed can also be packaged by the in the inventive container. Although specific terms are employed herein, they are used in a generic and descriptive sense only and not for purposes of limitation.

The invention claimed is:

1. A container comprising:

a bottom wall;

at least one sidewall extending upwardly from the bottom wall, the sidewall terminating in an edge, and the sidewall having an inner and an outer surface, wherein the bottom wall and the at least one sidewall form a container interior;

a flexible bag having an open end and being disposed within the interior of the container and over the top edge of the container; and a slide ring extending at least partially circumferentially about the outer surface of the sidewall, wherein the slide ring is:

affixed to the open end of the bag, frictionally engaged with the outer surface of the sidewall.

2. The container of claim 1, wherein the slide ring can be moved vertically over the outer surface of the container.

3. The container of claim 2, wherein when the slide ring is moved vertically, the bag also moves vertically within the interior of the container.

4. The container of claim 1, wherein when no human force is applied to the slide ring, the slide ring remains in position due to frictional forces between the slide ring and the outer surface of the container.

5. The container of claim 1, wherein the slide ring cannot move beyond the edge of the container sidewall.

6. The container of claim 1 wherein the container is cylindrical.

7. The container of claim 1 wherein the flexible bag has a vertical length which is longer than the vertical length of the container sidewall.

8. The container of claim 1 wherein the slide ring is bonded to an outer surface of the bag.

9. The container of claim 1 wherein the slide ring is bonded to an inner surface of the bag.

10. The container of claim 1 additionally comprising a flexible membrane seal affixed to the rolled edge of the sidewall.

11. The container of claim 1 additionally comprising an overcap.

12. The container of claim 11 additionally comprising a tear strip configured to cover the interface between the overcap and the slide ring.

13. The container of claim 12 wherein the tear strip prevents movement of the slide ring prior to removal of the tear strip and prevents removal of the overcap prior to removal of the tear strip.

14. The container of claim 1 additionally comprising one or more through holes in the sidewall.

15. A method for manufacturing a container comprising:

providing a flexible bag having an open end;

bonding a slide ring to the open end of the flexible bag, wherein the slide ring comprises an at least partially circumferential portion;

providing a container body having a bottom wall and at least one sidewall extending upwardly from the bottom wall, the sidewall terminating in an edge, and the sidewall having an inner and an outer surface, wherein the bottom wall and the at least one sidewall form a container interior;

applying the slide ring and flexible bag circumferentially to the outer surface of the sidewall, over the edge, wherein the slide ring frictionally engages the outer surface of the sidewall;

disposing the flexible bag into the interior of the container;

filling the bag with products; and applying a closure to the container.

16. The method of claim 15, wherein the bag is air blown into the interior of the container.

17. The method of claim 15, wherein the closure comprises a membrane seal.

18. The method of claim 15, wherein the closure comprises an overcap.

19. The method of claim 15, comprising bonding the slide ring to an outer surface of the bag.

20. The method of claim 15, comprising bonding the slide ring to an inner surface of the bag.

* * * * *